United States Patent [19]

Staerzl et al.

[11] Patent Number: 4,763,625

[45] Date of Patent: Aug. 16, 1988

[54] COLD START FUEL ENRICHMENT CIRCUIT

[75] Inventors: Richard E. Staerzl; Norman H. Radtke, both of Fond du Lac; Leonard S. Hummel, Vandyne, all of Wis.

[73] Assignee: Brunswick Corporation, Skokie, Ill.

[21] Appl. No.: 60,078

[22] Filed: Jun. 9, 1987

[51] Int. Cl.[4] ..... F02D 41/06; F02D 41/14

[52] U.S. Cl. ..... 123/435; 123/479; 123/179 G

[58] Field of Search ..... 123/179 G, 179 L, 491, 123/435, 479; 73/35

[56] References Cited

U.S. PATENT DOCUMENTS

| | | | |
|---|---|---|---|
| 3,749,070 | 7/1973 | Oishi et al. | 123/491 |
| 3,931,808 | 1/1976 | Rachel | 123/179 L |
| 4,114,570 | 9/1978 | Marchak et al. | 123/179 G |
| 4,184,460 | 1/1980 | Harada et al. | 123/491 |
| 4,243,009 | 1/1981 | Staerzl | 123/435 |
| 4,312,214 | 1/1982 | Kramer et al. | 73/35 |
| 4,312,314 | 1/1982 | McChesney et al. | 123/438 |
| 4,349,000 | 9/1982 | Staerzl | 123/491 |
| 4,391,254 | 7/1983 | Staerzl | 123/478 |
| 4,429,673 | 2/1984 | Staerzl | 123/491 |
| 4,478,068 | 10/1984 | Bonitz et al. | 73/35 |
| 4,481,924 | 11/1984 | Kobayashi | 123/425 |
| 4,498,434 | 2/1985 | Baltz et al. | 123/187.5 R |
| 4,521,769 | 6/1985 | Dudeck et al. | 123/479 |
| 4,528,955 | 7/1985 | Sugiura | 73/35 |
| 4,621,602 | 11/1986 | Furuyama | 123/425 |
| 4,664,083 | 5/1987 | Nix et al. | 123/425 |
| 4,667,637 | 5/1987 | Staerzl | 123/435 |

FOREIGN PATENT DOCUMENTS 57-199919 12/1982 Japan .

*Primary Examiner*—Andrew M. Dolinar

*Attorney, Agent, or Firm*—Andrus, Sceales, Starke & Sawall

[57] ABSTRACT

A cold start fuel enrichment circuit for an internal combustion engine includes a thermistor (204) sensing engine temperature, a voltage source ($V_{DD}$) continually biasing the thermistor such that the voltage across the thermistor continually varies with engine temperature and provides an output fuel enrichment signal, and a circuit (218, 220) connecting the engine battery (206) through the start switch (208) to the thermistor to additionally bias the thermistor during cranking of the engine. A combination cold start and knock prevention fuel enrichment circuit is also provided.

5 Claims, 1 Drawing Sheet

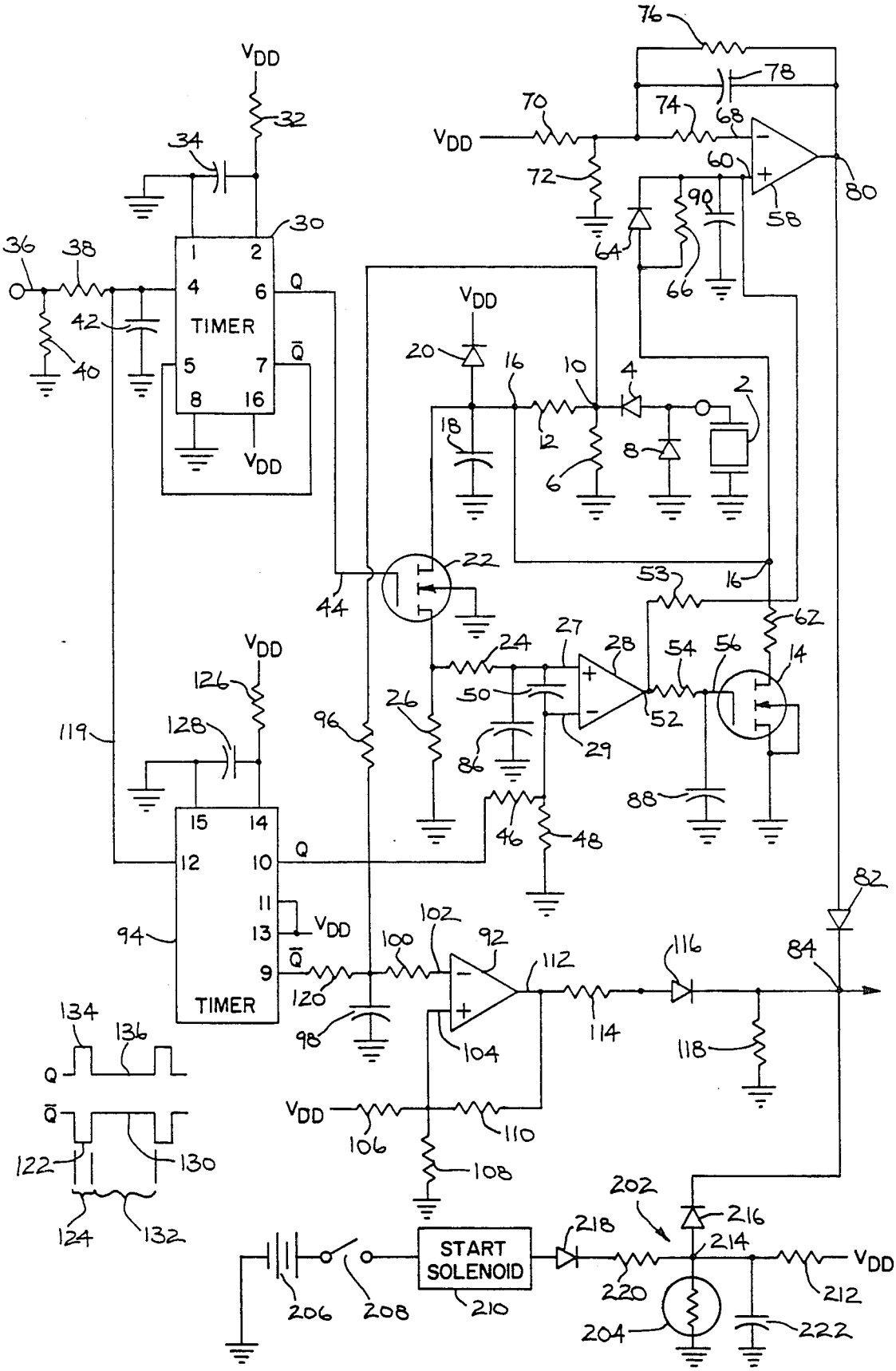
TIMER
TIMER
START SOLENOID
VDD
Q
Q̄

COLD START FUEL ENRICHMENT CIRCUIT

CROSS REFERENCE TO RELATED APPLICATIONS

Reference is made to commonly owned copending U.S. application Ser. No. 07/059,792, filed on even date herewith and U.S. application Ser. No. 07/059,791, filed on even date herewith.

BACKGROUND AND SUMMARY

The invention relates to cold start fuel enrichment circuitry for a two cycle internal combustion engine, and to a combined cold start and knock prevention circuit.

During starting and while the engine is cold, a richer fuel-air mixture is desirable. Various enrichment circuits are known in the art. The present invention provides further improvements in such circuitry.

The invention further facilitates combination with knock prevention circuitry and with fuel control circuitry in the above noted co-pending applications. Premature firing of the fuel-air mixture in the combustion chamber of an internal combustion engine causes the mixture to explode rather than burn smoothly. This phenomena is called knock or detonation, and results in loss of power and possible engine damage. Knock becomes more severe with lower fuel octane rating. It is known in the art to sense knock with an audio transducer mounted to the engine, and to reduce knock by supplying a richer fuel-air mixture, U.S. Pat. Nos. 4,243,009 and 4,667,637, incorporated herein by reference.

BRIEF DESCRIPTION OF THE DRAWING

The sole drawing is a circuit diagram showing circuitry in accordance with the invention.

DETAILED DESCRIPTION

FIG. 1 shows a cold start fuel enrichment circuit 202 for a two cycle internal combustion engine, such as shown in U.S. Pat. No. 4,349,000, incorporated by reference. Circuit 202 includes an NTC, negative temperature coefficient, thermistor 204 sensing engine temperature, as known in the art, for example NTC thermistor 66 in said U.S. Pat. No. 4,349,000, and NTC thermistor 81 in U.S. Pat. No. 4,429,673, incorporated by reference. The engine includes a battery 206 and a start switch 208 for applying battery voltage to start solenoid 210 to crank and start the engine. A voltage source $V_{DD}$ continually biases thermistor 204 through resistor 212 at node 214 such that the voltage across thermistor 204 continually varies with engine temperature and provides an output fuel enrichment signal through diode 216 to output node 84, which output node also receives a fuel enrichment signal through diodes 82 and/or 116 from knock detection circuitry, to be described, to supply a richer fuel-air mixture, U.S. Pat. Nos. 4,243,009 and 4,667,637, incorporated herein by reference.

At cold start, engine temperature is low and the resistance of NTC thermistor 204 is high, whereby a large portion of $V_{DD}$ is dropped across thermistor 204 such that a high voltage value is present at node 214, which in turn provides the fuel enrichment signal at output node 84. As engine temperature increases, the resistance of NTC thermistor 204 decreases, and thermistor 204 conducts more current therethrough from voltage source $V_{DD}$, whereby to lower the voltage at node 214, reducing or eliminating the fuel enrichment signal at output node 84 through diode 216.

Diode 218 and resistor 220 connect battery 206 through switch 208 and start solenoid 210 to thermistor 204 at node 214 such that battery voltage additionally biases the thermistor during cranking of the engine. Capacitor 222 provides filtering and spike suppression. During cranking of the engine, the voltage at node 214 across thermistor 204 providing the fuel enrichment signal includes components of both battery 206 and voltage source $V_{DD}$. After cranking, the fuel enrichment signal at node 214 includes the component from voltage source $V_{DD}$, but not from battery 206. The voltage at node 214 forward biases diode 216 and provides the fuel enrichment signal at output node 84.

The knock detection circuit includes an audio transducer 2, for example as commercially available from Telex Corporation, formerly Turner Microphone, of Minneapolis, Minn., mounted to the cylinder head of the cylinder most prone to knocking in a multiple cylinder two cycle internal combustion engine, as in the above noted patents. As in incorporated U.S. Pat. No. 4,667,637 the audio transducer is preferably tuned to the mechanical resonant frequency of the cylinder to enhance the efficiency of the transducer. Audio transducer 2 senses audio signals indicative of engine combustion and occurring within the combustion chamber of the engine and converts the audio signals into an electrical output voltage including a portion representing background noise and a portion representing detonation.

As noted in incorporated U.S. Pat. No. 4,667,637 for each engine cycle, the transducer output signal voltage is characterized by one phase during which detonation is unlikely to occur and by another phase during which any detonation is likely to occur. Immediately following the ignition signal for the respective cylinder, there is a dead-time interval of approximately 1 or 1.5 milliseconds during which detonation is unlikely to occur. During this interval, there is a buildup of pressure and heat, but usually no detonation, and hence transducer 2 only senses background noise during such interval. Following this first interval, there is a second interval which lasts until the next ignition pulse. Detonation, if any, is likely to occur during the second interval. In the present invention, the first interval is used for sampling sensed background noise and adjusting transducer output voltage.

Transducer 2 has an AC output which is rectified through diode 4 having a ground reference resistor 6. The other half cycle is conducted through diode 8. The rectified transducer output voltage at node 10 is fed through a voltage divider network provided by resistor 12 and FET 14 to provide a transducer output voltage at node 16 which varies according to conduction of FET 14. The more conductive FET 14, the more current it conducts to ground, and the lesser the voltage at node 16. Conversely, if FET 14 becomes less conductive, it conducts less current to ground, and the voltage at node 16 rises. In this manner, the amplitude of the transducer output voltage at node 16 is adjusted.

The transducer output voltage at node 16 is filtered by capacitor 18. Diode 20 to voltage reference $V_{DD}$ provides overshoot protection to protect the solid state chips in the circuit. The transducer output voltage from node 16 is then applied through FET 22 and reduced by the voltage divider network provided by resistors 24 and 26 and applied to the noninverting input 27 of comparator 28, provided by an operational amplifier. Conduction of FET 22 is controlled by a monostable multivibrator timer 30, provided by a CD 4538 timer with manufacturer-assigned pin numbers shown. Timer 30 has a one millisecond timing interval set by the RC timing circuit provided by resistor 32 and capacitor 34. The ignition pulse signal voltage on line 36 is reduced by the voltage divider network provided by resistors 38 and 40 and filtered by capacitor 42 and applied to timer 30. In response to such ignition pulse, the Q output of timer 30 goes high for one millisecond, and then goes low until the next ignition pulse.

The Q output of timer 30 is connected to control terminal 44 of FET 22 and biases the latter into conduction for the noted one millisecond interval, which provides the above noted first phase or timing interval for dead-time sampling of sensed background noise. During this interval, transducer output voltage from node 16 is applied through conductive FET 22 to the noninverting input 27 of comparator 28 for comparison against a reference voltage at the comparator's inverting input 29 supplied from a voltage source provided by the Q output of timer 94, to be described, through the voltage divider network provided by resistors 46 and 48. Capacitor 50 provides filtering between the inverting and noninverting comparator inputs. The higher the voltage amplitude at comparator input 27 relative to comparator input 29, the higher the voltage amplitude at comparator output 52. The comparator output voltage is supplied through resistor 54 to control terminal 56 of FET 14 to bias the latter into conduction, the higher the bias the more the conduction.

In operation during the noted initial one milisecond interval following an ignition pulse, an increase in sensed background noise will cause a higher amplitude transducer output voltage at node 16, which is applied through conductive FET 22 to comparator input 27, which in turn increases the bias at comparator output 52 applied to FET control terminal 56, which in turn increases conduction of FET 14, which in turn lowers the transducer output voltage at node 16 through resistor 62. Conversely, a reduction in sensed background noise provides a reduced amplitude transducer output voltage at node 16, which is applied through conductive FET 22 to comparator input 27, which in turn reduces the comparator output bias at output 52 applied to control terminal 56, which in turn reduces conduction of FET 14, which in turn increases transducer output voltage at node 16. This automatic control of the gain of FET 14 provides conduction modulation according to sensed background noise, which in turn affects the transducer output voltage at node 16. This self-adaptation is provided by transistor 14 in the feedback loop to comparator input 27. The automatic gain control is gated by timer 30 and FET 22.

A detonation threshold detector includes operational amplifier 58 having its noninverting input 60 connected to node 16 through resistor 66 and parallel diode 64. The inverting input 68 of comparator 58 is supplied with a reference voltage from voltage source $V_{DD}$ reduced by the voltage divider network provided by resistors 70 and 72 and supplied through resistor 74. The gain of op amp 58 is set by the feedback loop including resistors 76, 70 and 72, and filtering is provided by capacitor 78. When the voltage at op amp input 60 rises above that at op amp input 68, the op amp output 80 goes high, which high signal is supplied through diode 82 to output 84 providing a knock-detected signal for fuel enrichment, as noted in said incorporated patents.

As above noted, during the one millisecond initial timing interval, the circuit self-adapts to varying sensed background noise and provides gated automatic gain control to vary the transducer output voltage at node 16. During this interval, capacitor 86 at comparator input 27 charges. At the end of the one millisecond background noise sampling interval, the Q output of timer 30 goes low which turns off transistor 22. Charged capacitor 86 maintains voltage at comparator input 27 upon termination of such interval, in order to maintain the state at comparator output 52. Capacitor 88 at transistor control terminal 56 likewise has previously been charged during the initial interval, and upon termination of such interval will maintain a bias on control terminal 56 to maintain FET 14 conductive, to in turn maintain approximately the same resistance value across the main terminals of FET 14 between node 16 and ground. Capacitors 86 and 88 maintain a relatively smooth DC bias on respective terminals 27 and 56 at the end of the initial sampling interval to maintain the gain of transistor 14 until the next ignition pulse. The next ignition pulse will occur in about 2–2.5 milliseconds depending on engine speed.

Detonation threshold detector 58 responds to a predetermined increase in the amplitude of the transducer output voltage at node 16 above the amplitude representing sensed background noise, and outputs the knock-detected signal at output 84. During the initial timing interval, capacitor 90 at op amp input 60 charges from node 16 through resistor 66 and diode 64. Capacitor 90 also charges through resistor 53 from output 52 of comparator 28, to provide a higher charge on capacitor 90 for higher sensed background noise. During the initial timing interval, the voltage across capacitor 90 is not sufficient to trigger threshold detector 58. At the end of the initial one millisecond timing interval, capacitor 90 maintains a bias at comparator input 60. When detonation occurs, there is a substantial increase in the voltage at node 16. Detonation threshold detector 58 responds to the increase in the amplitude of the portion of the transducer output voltage representing detonation above the amplitude of the portion of the transducer output voltage representing sensed background noise, and outputs the noted knock-detected signal.

Fail-safe and idle override circuitry includes comparator 92 and monostable multivibrator timer 94, provided by a CD 4538 timer with manufacturer-assigned pin numbers shown. Comparator 92 responds to loss of transducer output voltage at node 10 to provide a knock-detected signal at output 84 in a fail-safe mode. Timer 94 responds to engine speed below a given or idle speed to prevent the fail-safe mode even if a low amplitude transducer output voltage, corresponding to low amplitude audio signals at idle, appears to be a loss of transducer output voltage.

Transducer output voltage at node 10 is supplied through resistor 96, filtered by capacitor 98 and supplied through resistor 100 to inverting input terminal 102 of comparator 92, provided by an operational amplifier. The noninverting input 104 of comparator 92 is supplied with a reference voltage from source $V_{DD}$ reduced by the voltage divider network provided by resistors 106 and 108. Resistor 110 is connected between comparator output 112 and input 104. Comparator output 112 is connected through resistor 114 and diode 116 and protective ground resistor 118 to output 84. During normal operation, transducer output voltage at node 10 biases comparator input 102 higher than input 104, such that comparator output 112 is low, and hence there is no knock-detected signal at output 84. Upon loss of the transducer output voltage at node 10, e.g. by a failure of transducer 2, or a loose connection, etc., the voltage at comparator input 102 drops below the voltage at comparator input 104, and comparator output 112 goes high, which in turn provides a knock-detected signal at output 84. This provides a fail-safe mode.

Timer 94 provides an idle override feature. The ignition pulse from line 36 through resistor 38 is applied at line 119 to timer 94. The $\overline{Q}$ output of timer 94 is connected through resistors 120 and 100 to comparator input 102. Timer 94 responds to ignition pulses and outputs timing pulses at its $\overline{Q}$ output including a negative polarity pulse 122 for a given interval 124 set by the RC timing circuit provided by resistor 126 and capacitor 128, followed by a positive polarity pulse 130 for the interval 132 until the next ignition pulse. At low engine speed, there is sufficient duration of positive polarity pulse 130 to maintain the voltage at comparator input 102 above that at comparator input 104. This disables comparator 92 from generating a knock-detected signal at output 84 regardless of a decrease in transducer output voltage at node 10 which would otherwise decrease the voltage at comparator input 102 below that at comparator input 104.

With increasing engine speed above idle or above some given value, the duration of positive polarity pulses 130 becomes shorter because the next ignition pulses occur sooner. There is then insufficient duration of positive polarity pulses 130 to maintain the voltage at comparator input 102 above that at input 104, and hence comparator 92 is controlled by the transducer output voltage at node 10 supplied to comparator input 102, and comparator 92 generates a knock-detected signal at output 84 when the voltage at input 102 drops below that at input 104.

The fail-safe and idle override circuitry responds to loss of transducer output voltage at node 10 to provide the knock-detected signal at output 84 in a fail-safe mode. The circuitry responds to engine speed below a given speed and prevents the fail-safe mode even if a low amplitude transducer output voltage at node 10, corresponding to low amplitude audio signals at idle, appears to be a loss of transducer output voltage. At engine speeds above idle, input 102 of comparator 92 is controlled solely by the transducer output voltage at node 10 through resistor 96.

Timer 94 outputs timing pulses at its Q output including a positive polarity pulse 134 for the noted given interval 124, followed by a negative polarity pulse 136 for the noted interval 132 until the next ignition pulse. With increasing engine speed, the duration of negative polarity pulses 136 becomes shorter because the next ignition pulses occur sooner, and hence there is increasing voltage at inverting input 29 of comparator 28. Conversely, the reference voltage at comparator input 29 decreases with decreasing engine speed. At low engine speeds, below 3,000 rpm, the voltage at comparator input 29 is low enough that comparator output 52 will remain high, which in turn keeps FET 14 conductive, which in turn provides minimum voltage at node 16 during the initial timing interval, thus disabling knock detecting during initial engine acceleration.

The fuel enrichment signal from the cold start circuitry is provided through diode 216 to output node 84. The fuel enrichment signal from the knock detection circuitry is provided through diode 82 to output node 84. The fuel enrichment signal from the fail-safe and idle override circuitry is provided through diode 116 to output node 84. Diodes 216, 82 and 116 provide isolation such that output node 84 operates as an OR gate. Diode 216 passes the fuel enrichment signal from node 214 to output node 84, and blocks passage of the fuel enrichment signal from output node 84 to node 214. Diode 82 passes the fuel enrichment signal from output 80 of comparator 58 of the knock detection circuitry to output node 84, and blocks passage of the fuel enrichment signal from output node 84 to output 80 of comparator 58. Diode 116 passes the fuel enrichment signal from output 112 of comparator 92 of the fail-safe and idle override circuitry to output node 84, and blocks passage of the fuel enrichment signal from output node 84 to output 112 of comparator 92.

It is recognized that various equivalents, alternatives and modifications are possible within the scope of the appended claims.

We claim:

1. A cold start and knock prevention circuit having an output node providing a fuel enrichment signal for an internal combustion engine, comprising in combination:

transducer means sensing audio signals indicative of engine combustion and occurring within a combustion chamber of the engine and converting said audio signals into an electrical output voltage including a portion representing background noise and a portion representing detonation;

means for adjusting the amplitude of said transducer output voltage;

means sampling said portion of said transducer output voltage representing background noise and controlling said adjusting means to decrease the amplitude of said transducer output voltage for increased sensed background noise and to increase the amplitude of said transducer output voltage for decreased sensed background noise;

detonation threshold means responsive to a predetermined increase in the amplitude of said portion of said transducer output voltage representing detonation above the amplitude of said portion of said transducer output voltage representing background noise, and outputting a fuel enrichment signal to said output node;

a thermistor connected to said output node and sensing engine temperature;

a voltage source biasing said thermistor such that the voltage across said thermistor varies with engine temperature and provides an output fuel enrichment signal at said output node;

first isolation means isolating said fuel enrichment signal of said detonation threshold means from said thermistor and said voltage source;

second isolation means isolating said fuel enrichment signal of said thermistor and said voltage source from said detonation threshold means.

2. The invention according to claim 1 wherein said first isolation means comprises a first diode connected in series aiding relation from said detonation threshold means to said output node and passing the fuel enrichment signal from said detonation threshold means to said output node and blocking passage of the fuel enrichment signal from said output node to said detonation threshold means, and wherein said second isolation means comprises a second diode connected in series aiding relation from a node between said thermistor and said voltage source to said output node, and passing the fuel enrichment signal from said second mentioned node to said output node, and blocking passage of the fuel enrichment signal from said output node to said second node.

3. The invention according to claim 2 comprising combination fail-safe and idle override means comprising means responsive to loss of said transducer output voltage to provide a fuel enrichment signal at said output node, and responsive to engine speed below a given speed and preventing said fail-safe mode even if a low amplitude transducer output voltage, corresponding to low amplitude audio signals at idle, appears to be a loss of said transducer output voltage;

third isolation means comprising a third diode connected in series aiding relation from said fail-safe and idle override means to said output node, and passing the fuel enrichment signal from said fail-safe and idle override means to said output node, and blocking passage of the fuel enrichment signal from said output node to said fail-safe and idle override means.

4. The invention according to claim 3 wherein said engine includes a battery and a start switch, and comprising means connecting said battery through said start switch to said second node such that battery voltage biases said thermistor during cranking of said engine in addition to the bias from said voltage source, such that during cranking of the engine the voltage across said thermistor providing the fuel enrichment signal through said second diode includes components of both said battery and said voltage source, and such that after cranking the fuel enrichment signal through said second diode includes the component from said voltage source but not said battery.

5. The invention according to claim 4 comprising a fourth diode connected in series aiding relation between said battery and said second node, and wherein said fourth diode has a cathode connected to the anode of said second diode, and wherein each of said first, second and third diodes has a cathode connected in common at said output node.

* * * * *